US009173542B2

(12) United States Patent
Welch

(10) Patent No.: US 9,173,542 B2
(45) Date of Patent: Nov. 3, 2015

(54) DISHWASHER WITH OFFSET OPEN FACE

(75) Inventor: Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 668 days.

(21) Appl. No.: 13/603,794

(22) Filed: Sep. 5, 2012

(65) Prior Publication Data

US 2014/0060597 A1 Mar. 6, 2014

(51) Int. Cl.
*A47L 15/42* (2006.01)
*A47L 15/44* (2006.01)
*A47L 15/48* (2006.01)

(52) U.S. Cl.
CPC ..... *A47L 15/4246* (2013.01); *A47L 15/4231* (2013.01); *A47L 15/4291* (2013.01); *A47L 15/4293* (2013.01); *A47L 15/4409* (2013.01); *A47L 15/4463* (2013.01); *A47L 15/488* (2013.01)

(58) Field of Classification Search
CPC ..... A47L 15/4246; A47L 15/4248; A47L 15/4293; A47L 15/483; A47L 15/4291; A47L 15/4445; A47L 15/4229; A47L 15/4231; A47L 15/4263; A47L 15/44; A47L 15/4409; A47L 15/4251
USPC ..... 134/115 R, 200; 312/198, 228, 228.1
See application file for complete search history.

(56) References Cited

U.S. PATENT DOCUMENTS

| | | | | |
|---|---|---|---|---|
| 2,635,941 | A | 4/1953 | Stoddard | |
| 2,652,854 | A | 9/1953 | Stoddard | |
| 2,678,051 | A | 5/1954 | Stoddard | |
| 4,307,742 | A | 12/1981 | Schrott | |
| 5,176,297 | A | 1/1993 | Mooney et al. | |
| 6,719,383 | B2 * | 4/2004 | Elick et al. | 312/228 |
| 7,156,113 | B2 * | 1/2007 | Jerg et al. | 134/93 |
| 7,231,928 | B2 | 6/2007 | Dingler et al. | |
| 7,445,013 | B2 | 11/2008 | Vanderroest et al. | |
| 7,506,655 | B2 * | 3/2009 | Assmann | 134/56 D |
| 7,523,758 | B2 | 4/2009 | Vanderroest et al. | |
| 7,578,303 | B2 | 8/2009 | Daume et al. | |
| 7,731,309 | B2 * | 6/2010 | Gorini et al. | 312/228 |
| 2004/0177654 | A1 * | 9/2004 | Marks | 68/13 A |
| 2006/0060229 | A1 | 3/2006 | Gonska et al. | |
| 2009/0090401 | A1 | 4/2009 | Feddema | |
| 2009/0118848 | A1 * | 5/2009 | Santinato et al. | 700/90 |
| 2010/0012161 | A1 | 1/2010 | Classen et al. | |

(Continued)

FOREIGN PATENT DOCUMENTS

| | | | |
|---|---|---|---|
| CN | 101947091 | A | 1/2011 |
| DE | 1938198 | A1 | 2/1971 |
| DE | 3021746 | A1 | 12/1981 |

(Continued)

OTHER PUBLICATIONS

German Search Report for Counterpart DE102013107087, Mar. 19, 2014.

*Primary Examiner* — Michael Barr
*Assistant Examiner* — Rita Adhlakha

(57) ABSTRACT

A dishwasher having a tub having a front defining an outer periphery, a treating chamber defined by the tub and having an open face located at the front of the tub and within the outer periphery, and a cover selectively closing the open face. A usable space configured to receive a component of the dishwasher can be at least partially defined by the outer periphery of the tub. The cover is sized to overlie the usable space when the cover closes the open face.

34 Claims, 5 Drawing Sheets

(56) References Cited

U.S. PATENT DOCUMENTS

| | | | |
|---|---|---|---|
| 2010/0043852 | A1 | 2/2010 | Classen et al. |
| 2011/0073141 | A1 | 3/2011 | Jerg et al. |

FOREIGN PATENT DOCUMENTS

| | | | |
|---|---|---|---|
| DE | 3216315 | A1 | 11/1983 |
| DE | 3544580 | C1 | 6/1987 |
| DE | 4313539 | A1 | 10/1994 |
| EP | 0671143 | A1 | 9/1995 |
| EP | 0922677 | A2 | 6/1999 |
| EP | 0755650 | B1 | 6/2002 |
| EP | 1312296 | A1 | 5/2003 |
| EP | 1319360 | B1 | 4/2004 |
| EP | 2272415 | A2 | 1/2011 |
| EP | 2387936 | A1 | 11/2011 |
| GB | 966213 | | 8/1964 |
| GB | 2215992 | A | 10/1989 |
| GB | 2321590 | A | 8/1998 |
| WO | 2009027320 | A1 | 3/2009 |
| WO | 2011141145 | A1 | 11/2011 |

* cited by examiner

DISHWASHER WITH OFFSET OPEN FACE

BACKGROUND OF THE INVENTION

Dishwashers include a treating chamber in which utensils are placed to be washed according to an automatic cycle of operation. A tub can at least partially define a treating chamber, and can be located within a cabinet. A door is mounted to the cabinet for selectively closing the treating chamber. Water, alone, or in combination with a treating chemistry, forms a wash liquid that is distributed to the utensils during the cycle of operation. The wash liquid may be recirculated onto the utensils during the cycle of operation.

Components of the dishwasher are commonly mounted on both the tub or cabinet, and the door. For example, a controller, user interface, or chemistry dispenser can be provided on the door, while pumps, motors, condensers, and salt chambers for ion exchange softeners are provided with the tub or cabinet. Electrical wiring connecting the controller or user interface to electrical components on the tub/cabinet must be routed between the door and tub/cabinet, and is typically routed through a wiring harness at the hinge connection of the door.

SUMMARY OF THE INVENTION

The invention relates to a dishwasher for treating dishes according to a cycle of operation, comprising a tub having a front defining an outer periphery, a treating chamber defined by the tub and having an open face located at the front of the tub and within the outer periphery, and a cover selectively closing the open face.

In one aspect, the dishwasher further has a spraying system spraying liquid within the treating chamber and a recirculation system recirculating the liquid within the treating chamber. The open face is laterally offset within the outer periphery and defines a usable space between the outer periphery and an exterior of the treating chamber and the cover is sized to overlie the usable space when the cover closes the open face.

In another aspect, the dishwasher further has a dispensing system providing treating chemistry to the treating chamber and having at least one component. The treating chamber has at least one side partially defining the open face, wherein the treating chamber is not laterally centered within the outer periphery, which defines a space along the at least one side and within the outer periphery, with the at least one component located within the space, and the cover is sized to overlying the usable space when the cover closes the open face.

BRIEF DESCRIPTION OF THE DRAWING(S)

DESCRIPTION OF EMBODIMENT(S) OF THE INVENTION

Figure 1:
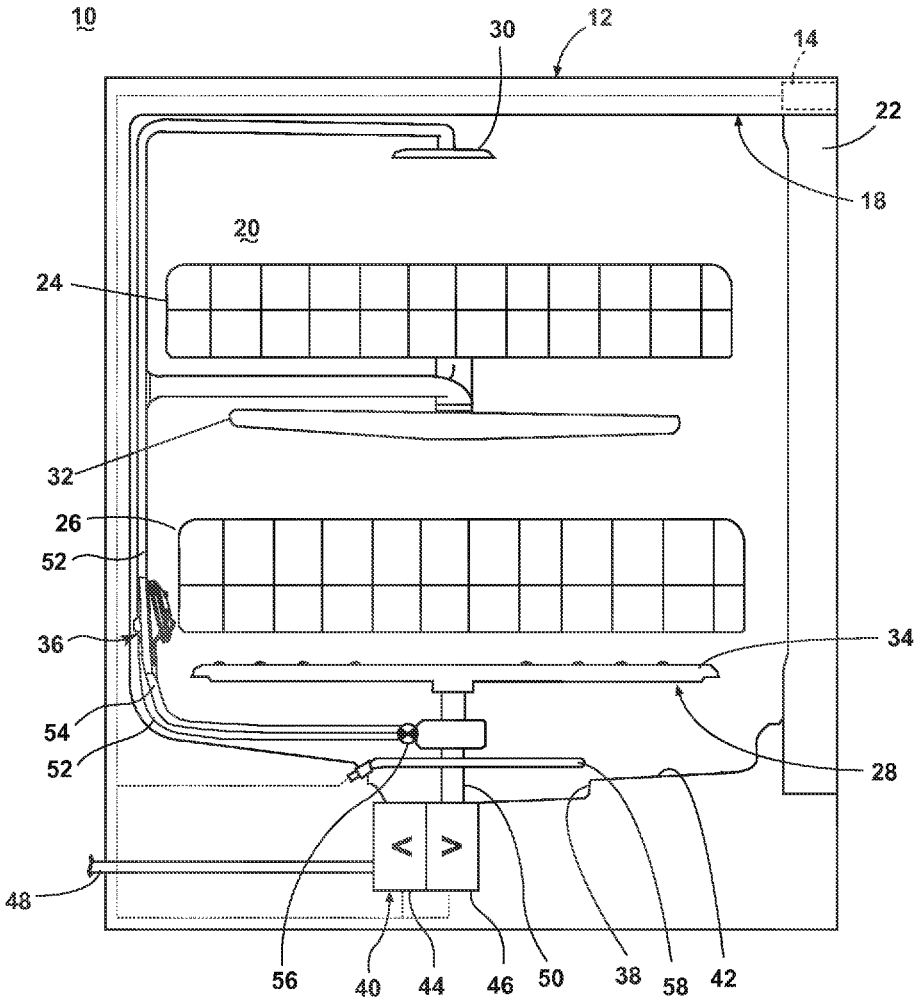
FIG. 1 is a schematic illustration of an automatic dishwasher according to a first embodiment of the invention.

Referring to FIG. 1, a first embodiment of the invention is schematically illustrated as an automatic dishwasher 10 for treating dishes according to a cycle of operation, and having a cabinet 12 defining an interior. Depending on whether the dishwasher 10 is a stand-alone or built-in, the cabinet 12 may be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi tub dishwashers, or drawer-type dishwashers. An electronic control system comprising a controller 14 may be located within the cabinet 12 and may be operably coupled to various components of the dishwasher 10 to implement one or more cycles of operation.

A tub 18 is located within the cabinet 12 and at least partially defines a treating chamber 20, with an access opening in the form of an open face. A cover, illustrated as a door 22, may be hingedly mounted to the cabinet 12 or tub 18.

Utensil holders in the form of upper and lower racks 24, 26 are located within the treating chamber 20 and receive utensils for being treated. The racks 24, 26 are mounted for slidable movement in and out of the treating chamber 20 for ease of loading and unloading. As used in this description, the term "utensil(s)" is intended to be generic to any item, single or plural, that may be treated in the dishwasher 10, including, without limitation: dishes, plates, pots, bowls, pans, glassware, and silverware. While not shown, additional utensil holders, such as a silverware basket on the interior of the door 22 or a third level rack above the upper rack 24 may also be provided.

A spraying system 28 may be provided for spraying liquid into the treating chamber 20 and is illustrated as having multiple sprayers in the form of an upper sprayer 30, a mid-level sprayer 32, a lower rotatable spray arm 34, and a spray manifold 36. The upper sprayer 30 may be located above the upper rack 24 and is illustrated as a fixed spray nozzle that sprays liquid downwardly within the treating chamber 20. Mid-level rotatable sprayer 32 and lower rotatable spray arm 34 are located, respectively, beneath upper rack 24 and lower rack 26 and are illustrated as rotating spray arms. The mid-level spray arm 32 may provide a liquid spray upwardly through the bottom of the upper rack 24. The lower rotatable spray arm 34 may provide a liquid spray upwardly through the bottom of the lower rack 26. The mid-level rotatable sprayer 32 may optionally also provide a liquid spray downwardly onto the lower rack 26, but for purposes of simplification, this will not be illustrated herein. The spray manifold 36 may be fixedly mounted to the tub 18 adjacent to the lower rack 26 and may provide a liquid spray laterally through a side of the lower rack 26. The spray manifold 36 may not be limited to this position; rather, the spray manifold 36 may be located in virtually any part of the treating chamber 20. Suitable spray manifolds are set forth in detail in U.S. Pat. No. 7,445,013, issued Nov. 4, 2008, and titled "Multiple Wash Zone Dishwasher," and U.S. Pat. No. 7,523,758, issued Apr. 28, 2009, and titled "Dishwasher Having Rotating Zone Wash Sprayer," both of which are incorporated herein by reference in their entirety.

A liquid recirculation system may be provided for recirculating liquid from the treating chamber 20 to the spraying system 28. The recirculation system may include a sump 38 and a pump assembly 40. The sump 38 collects the liquid sprayed in the treating chamber 20 and may be formed by a sloped or recessed portion of a bottom wall of the tub 18. The pump assembly 40 may include both a drain pump 44 and a recirculation pump 46.

The drain pump 44 may draw liquid from the sump 38 and pump the liquid out of the dishwasher 10 to a household drain line 48. The recirculation pump 46 may draw liquid from the sump 38 and pump the liquid to the spraying system 28 to supply liquid into the treating chamber 20. While the pump assembly 40 is illustrated as having separate drain and recirculation pumps 44, 46 in an alternative embodiment, the pump assembly 40 may include a single pump configured to selectively supply wash liquid to either the spraying system 28 or the drain line 48, such as by configuring the pump to rotate in opposite directions, or by providing a suitable valve system. While not shown, a liquid supply system may include a water supply conduit coupled with a household water supply for supplying water to the sump 38.

As shown herein, the recirculation pump 46 has an outlet conduit 50 in fluid communication with the spraying system 28 for discharging wash liquid from the recirculation pump 46 to the sprayers 30-36. As illustrated, liquid may be supplied to the mid-level rotatable sprayer 32 and upper sprayer 30 through a supply conduit 52 and liquid may be supplied to the spray manifold 36 through a manifold supply conduit 54. Both conduits 52, 54 extend generally rearward from the recirculation pump 46 and upwardly along a rear wall of the tub 18. A diverter valve assembly 56 can be provided to selectively control the supply of liquid from the outlet conduit 50 to one of the conduits 52, 54. Additional diverters (not shown) may be provided within the spraying system 28 such that liquid may be selectively supplied to each of the sprayers 30-36. The sprayers 30-36 spray water and/or treating chemistry onto the dish racks 24, 26 (and hence any utensils positioned thereon) to effect a recirculation of the liquid from the treating chamber 20 to the liquid spraying system 28 to define a recirculation flow path.

A heating system having a heater 58 may be located within or near the sump 38 for heating liquid contained in the sump 38. A filtering system (not shown) may be fluidly coupled with the recirculation flow path for filtering the recirculated liquid.

The controller 14 may be operably coupled to various components of the dishwasher 10 to implement a cycle of operation in the treating chamber 20. For example, the controller 14 may be coupled with the recirculation pump 46 for circulation of liquid in the tub 18, the drain pump 44 for drainage of liquid from the tub 18, and the heater 58 for heating liquid in the tub 18. The controller 14 may also be coupled with the diverter valve 56 for selectively supplying wash liquid to the sprayers 30, 32, 34, 36. The controller 14 may also receive inputs from one or more sensors (not shown), examples of which are known in the art. Non-limiting examples of sensors that may be communicably coupled with the controller 14 include a temperature sensor, a moisture sensor, a door sensor, a detergent and rinse aid presence/type sensor(s).

The controller 14 may be provided with a memory and a central processing unit (CPU). The memory may be used for storing control software that may be executed by the CPU in completing a cycle of operation and any additional software. For example, the memory may store one or more pre-programmed cycles of operation that may be selected by a user. Alternately, the cycle of operation may be automatically selected by the controller 14 based on soil levels sensed by the dishwasher 10 to optimize the cleaning performance of the dishwasher 10 for a particular load of utensils. Examples of cycles of operation include normal, light/china, heavy/pots and pans, and rinse only. A cycle of operation may include one or more of the following steps: a wash step, a rinse step, and a drying step. The wash step may further include a pre-wash step and a main wash step. The rinse step may also include multiple steps such as one or more additional rinsing steps performed in addition to a first rinsing.

Figure 2:
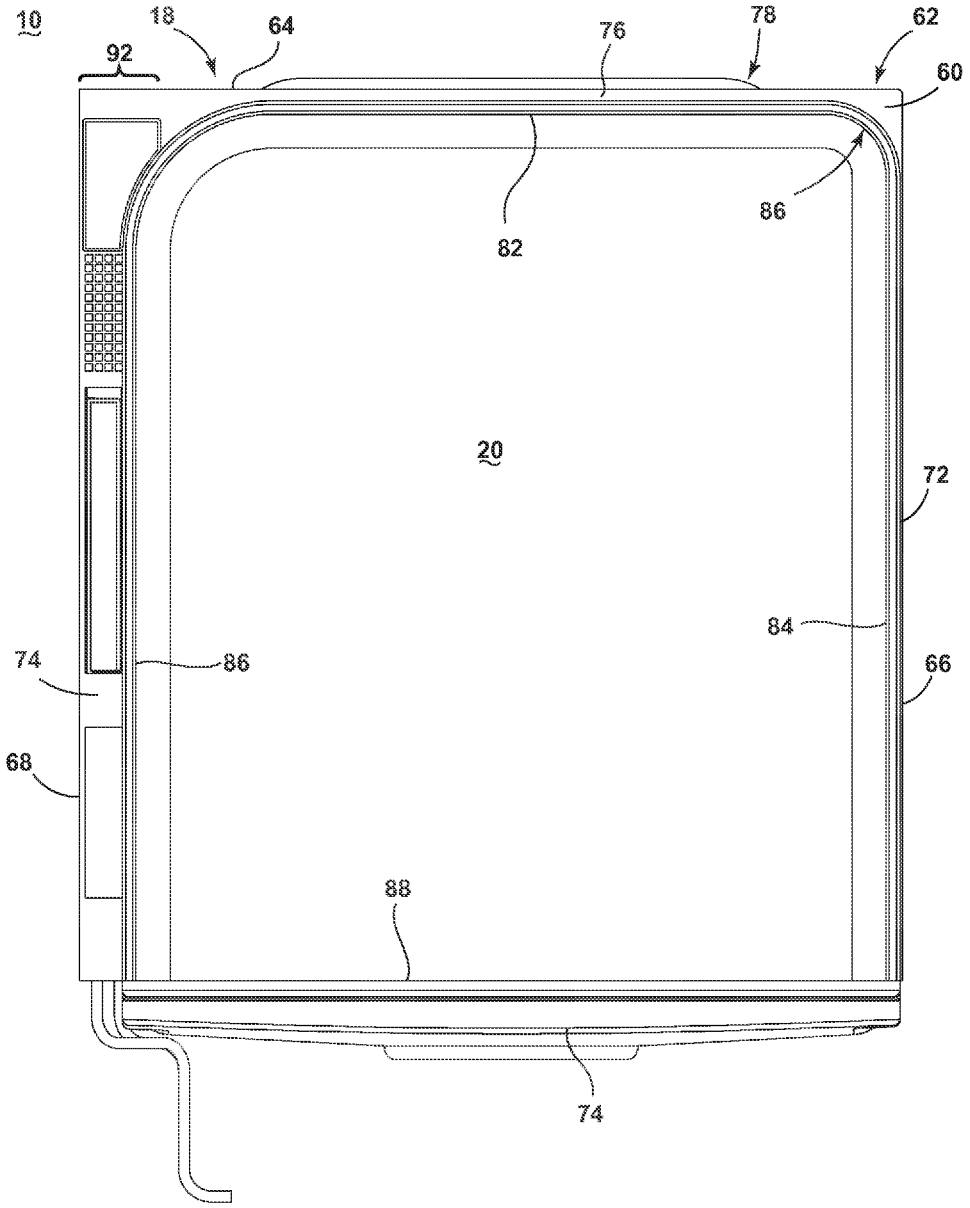
FIG. 2 is a front view of the automatic dishwasher from FIG. 1, with a door of the dishwasher removed for clarity.

FIG. 2 is a front view of the automatic dishwasher 10 from FIG. 1. Several components of the dishwasher 10, including the cabinet 12, the door 22, and components within the treating chamber 20 are not shown for clarity. The tub 18 has a front 60 defining an outer periphery 62 of the tub 18. The outer periphery 62 includes a top wall 64, a right side wall 66, a left side wall 68, and a bottom wall 70 which are joined together. Thus, the walls 64, 66, 68, 70 can define the outermost periphery of the tub 18. The front 60 can be at least partially defined by one or more flanges extending from the treating chamber 20. As shown, the front 60 can include a right lateral flange 72, a left lateral flange 74, and a top flange 76.

The tub 18 comprises a treating chamber peripheral wall 78 defining a treating chamber periphery 80. The treating chamber periphery 80 can reside within the outer periphery 62 of the tub 18, and can have a top wall 82, a right side wall 84, a left wall 86, and a bottom wall 88, which are joined together and which correspond to those walls 64, 66, 68, 70 of the outer periphery defined by the front 60.

The treating chamber 20 has an open face located at the front 60 of the tub 18, within the outer periphery 62 defined by the front 60. The treating chamber 20 is not centered within the outer periphery 62 defined by the front 60 in order to define a usable space 92 in which a subsystem or component of a subsystem can be located. The treating chamber 20 can be laterally or vertically off-center, depending on the desired location of the component or subsystem. The usable space 92 can be created by offsetting the open face of the treating chamber 20 within the outer periphery 62 defined by the front 60, which defines at least one usable space 92 between the outer periphery 62 and an exterior of the treating chamber 20. In being "offset", one of the walls 82, 84, 86, 88 of the treating chamber 20 can be closer to one of the walls 64, 66, 68, 70 of the tub 18 than the corresponding opposing walls. For example, with a lateral offset, the right side walls 66, 84 may be closer together than the left side walls 68, 86, or vice versa. With a vertical offset, the top walls 64, 82 may be closer together than the bottom walls 70, 88, or vice versa. The dishwasher 10 can have a combination of lateral and vertical offsets.

In the illustrated embodiment, the open face of the treating chamber 20 is laterally offset within the outer periphery 62 of the tub 18, such that the right side walls 66, 84 are closer together than the left side walls 68, 86, thus defining a useable space 92 between the left side wall 86 of the treating chamber 20 and the left side wall 68 of the tub 18. The useable space 92 is more specifically located between the tub outer periphery 62 and the treating chamber periphery 80, and extends vertically and laterally along the left side wall 86 of the treating chamber 20. In other embodiments, the usable space 92 can extend vertically along both side walls 84, 86 of the treating chamber 20, along the top wall 82 of the treating chamber 20, along the bottom wall 88 of the treating chamber 20, or any combination thereof. The usable space 92 can extend partially or fully along one or more walls of the treating chamber 20, and can further extend around one or more corners joining the walls of the treating chamber 20.

One manner in which the offset can be formed is by providing the front 60 with a lateral flange that is wider on one side than the other. In the illustrated embodiment, the left lateral flange 74 is wider than the right lateral flange 72 in order to provide the useable space 92 on the left side of the dishwasher 10. However, the overall outer dimensions and the foot print of the dishwasher 10 can remain unchanged.

It is also contemplated that the dishwasher 10 can be provided with at least one usable space 92 without having an offset between the treating chamber 20 and the tub 18. For example, the treating chamber 20 could be dimensioned smaller, which would enable the open face of the treating chamber 20 to remain centered within the outer periphery 62 defined by the tub 18 while also defining at least one usable space between the outer periphery 62 and an exterior of the treating chamber 20.

At least one subsystem with at least one component located within the usable space 92. The at least one usable space 92 can include multiple usable spaces in which different subsystems or components can be located. The subsystems or components can be modular in nature, such that the subsystems or components can be composed of standardized units for easy insertion into the usable space 92. The subsystems or components can further be removable from the usable space 92 in order to access, replace, or repair the subsystems. For example, the subsystems or components can be accessible from the front 60 of the tub 18.

Some non-limiting examples of subsystems which can be located in the usable space 92 include a chemistry dispensing system for storing and dispensing treating chemistry to the treating chamber 20, a water softening system for reducing the hardness of water supplied to the treating chamber 20 by reducing the concentration of calcium, magnesium, or other metal cations in the water, a condensing system for removing moisture from the treating chamber 20 during a drying cycle of the dishwasher 10, a liquid reuse system for capturing and storing liquid from a previous cycle of operation or phase of a cycle of operation for use during a subsequent cycle or phase, a regeneration system for regenerating softening agents used by a water softening system, an air venting system for exhausting air from the treating chamber 20, and an electronic control system for activating electronically-controlled components associated with the dishwasher 10 to implement a cycle of operation, and optionally for interpreting electrical signals sent by one or more sensors associated with the dishwasher 10. These subsystems can be coupled with the controller 14 to implement a cycle of operation in the treating chamber 20.

For a chemistry dispensing system, the at least one component can include a treating chemistry reservoir, a pump for supplying treating chemistry, a valve for selectively opening or closing a treating chemistry supply path, one or more conduits defining a treating chemistry supply path, or any combination thereof. Some non-limiting examples of treating chemistry reservoirs include a bulk dispensing cartridge, a dispensing cup, and a dispensing drawer.

For a water softening system, the at least one component can include a salt chamber, a salt chamber opening or inlet, a chute for connecting a salt chamber opening with a salt chamber, a salt chamber closure for selectively closing a salt chamber opening, or any combination thereof.

For a condensing system, the at least one component can include a condenser, such as a heat exchanger, which cools the moist air in the treating chamber 20 with dry ambient air, and thereby precipitates the moisture from the moist air, one or more conduits for supplying moist air or dry ambient air, a valve for controlling the supply of moist air or dry ambient air to a condenser, or any combination thereof.

For a liquid reuse system, the at least one component can include a storage tank in fluid communication with the recirculation system for storing liquid used during a cycle or phase for later reuse, a pump for pumping liquid to or from a storage tank, one or more conduits for supplying liquid to or from a storage tank, a valve for controlling the supply of liquid to or from a storage tank, or any combination thereof.

For a regeneration system, the at least one component can include a regeneration tank, a vent that is fluidly coupled with ambient air which permits excess air in a regeneration tank to be exhausted from the dishwasher 10, or any combination thereof.

For an air venting system, the at least one component can include a vent that is fluidly coupled with ambient air which permits excess air in the treating chamber 20 to be exhausted from the dishwasher 10, a blower or fan for forcing air through a vent, a valve for selectively opening or closing a vent, an actuator for selectively moving a valve, or any combination thereof.

For an electronic control system, the at least one component can include a controller which may be operably coupled with various components of the dishwasher 10 to implement a cycle of operation, a control panel or a user interface enabling a user to input commands to a controller and receive information about a selected cycle of operation, and one or more sensors coupled with a controller, or any combination thereof. Non-limiting examples of sensors include a moisture sensor, a turbidity sensor, an air flow sensor, a chemistry amount sensor, and positional sensors for the door 22.

Figure 3:
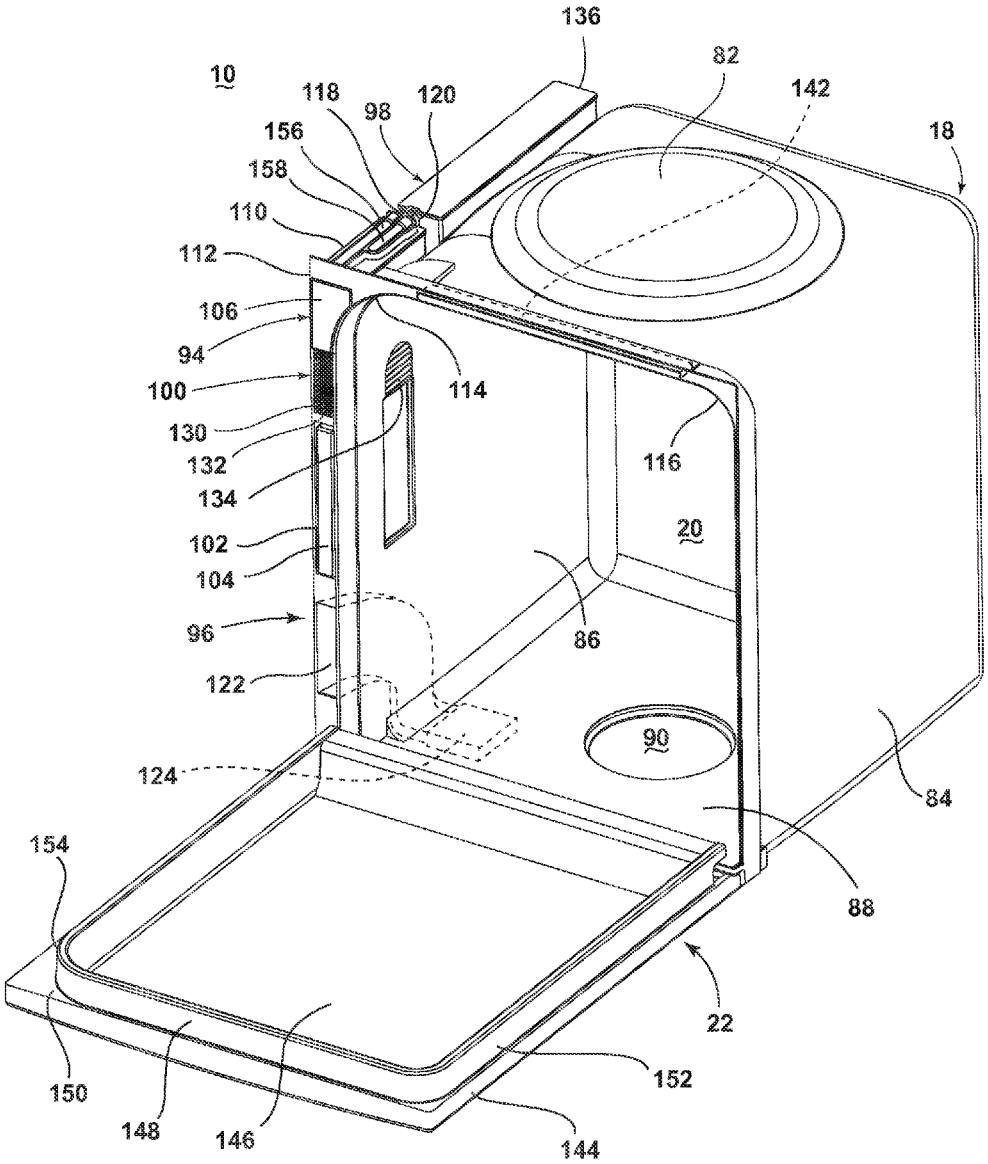
FIG. 3 is a right perspective view of the automatic dishwasher from FIG. 1, with the door of the dishwasher in an open position.

FIG. 3 is a perspective view of the automatic dishwasher 10 from FIG. 1, with the door 22 of the dishwasher 10 in an open position. Several components of the dishwasher 10, including the cabinet 12 and components within the treating chamber 20 are not shown for clarity. The bottom wall 88 is shown as having an opening 90 for accommodating the lower spray arm 34 and forming the sump 38 (FIG. 1), neither of which are shown in FIG. 3 for clarity. The illustrated dishwasher 10 is provided with a chemistry dispensing system 94, a water softening system 96, a liquid reuse system 98, and an air venting system 100, all of which have at least one component located in the usable space 92.

The chemistry dispensing system 94 has at least one treating chemistry reservoir located within the usable space 92, and is shown as having two separate reservoirs in the form of a cartridge receiver 102 for holding a bulk dispensing cartridge 104 removable through the front 60 and a dispensing drawer 106 slidable through the front 60. The dispensing drawer 106 includes a bulk rinse aid dispenser 107 configured to hold multiple doses of rinse aid at least one cup 108, 109 configured to hold a single dose of treating chemistry. The dispensing cartridge 104 is configured to hold multiple doses of treating chemistry, or of multiple treating chemistries. As used herein, the term "single dose of treating chemistry", and variations thereof, refers of an amount or volume of treating chemistry sufficient for one cycle of operation of the dishwasher 10. The amount or volume of the wash aid may vary depending on the selected cycle, but only enough for one cycle is used. As used herein, the term "multiple doses of treating chemistry", and variations thereof, refers to an amount of treating chemistry sufficient for multiple cycles of operation. Some non-limiting examples of treating chemistry include detergents, pre-wash detergents, rinse aids, and bleach, Thus, in one example, the dispensing drawer 106 can hold a single dose of detergent in the cup 108, a single dose of pre-wash detergent in cup 109, and multiple dose of rinse aid in the rinse aid dispenser 107, and the bulk dispensing cartridge 104 can hold multiple does of detergent and multiple doses of rinse aid.

Figure 4:
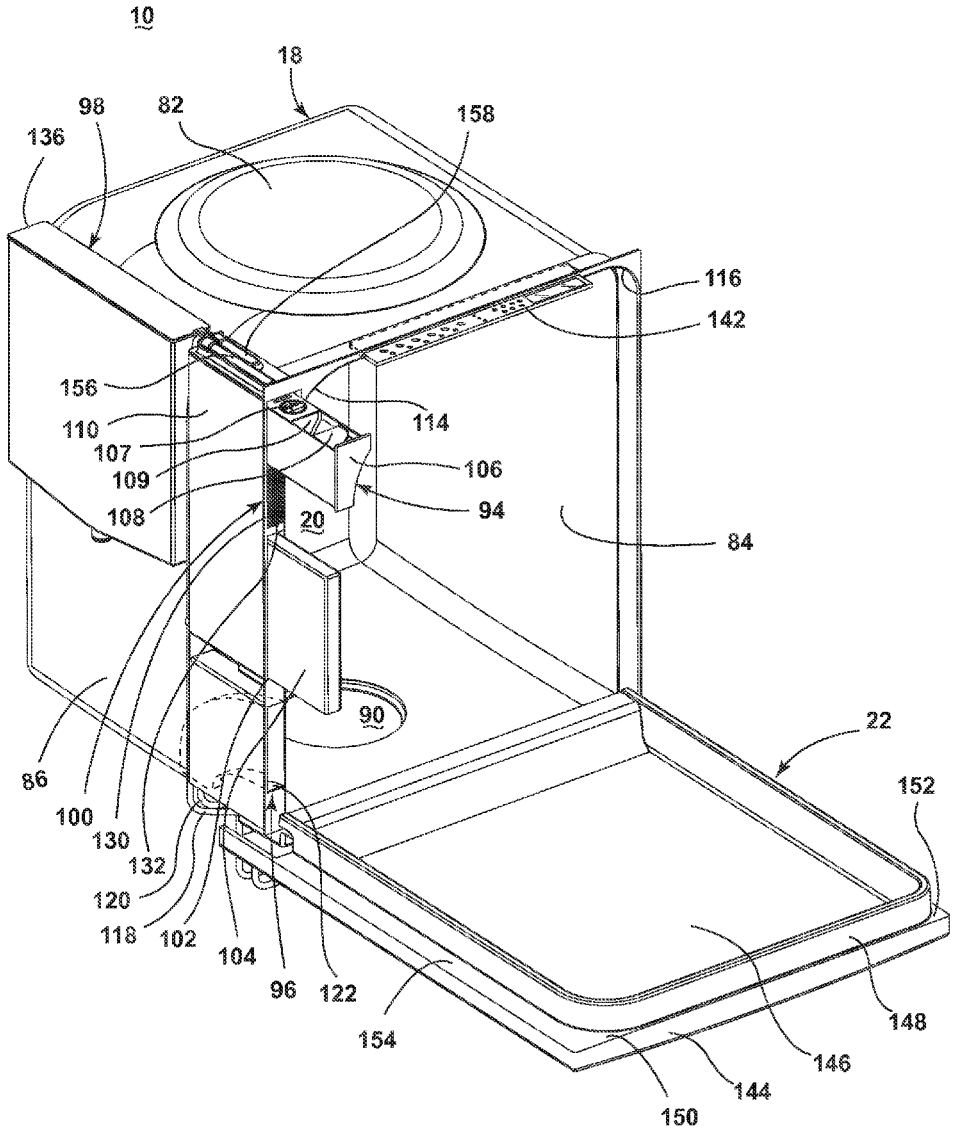
FIG. 4 is a left perspective view of the automatic dishwasher from FIG. 1, with the door of the dishwasher in an open position.

A housing 110 can be provided within the usable space 92, along the left side wall 86 of the tub 18, and can include the cartridge receiver 102 and a drawer receiver 112 for the dispensing drawer 106, such that the dispensing drawer 106 can be slid into the drawer receiver 112, as shown in FIG. 3, for a dispensing operation, and slid out of the drawer receiver 112, as shown in FIG. 4, for filling the rinse aid dispenser 107 and cup(s) 108, 109 with treating chemistry. The dispensing cartridge 104 can likewise be slid into the cartridge receiver 102, as shown in FIG. 3, for a dispensing operation, and slid out of the cartridge receiver 102, as shown in FIG. 4, for filling the dispensing cartridge 104 with a treating chemistry or replacement of the dispensing cartridge 104.

As shown herein the top wall 82 and left side wall 86 of the tub 18 join to define a left junction 114, and at least a portion of the dispensing drawer 106 is located at the left junction 114. The left junction 114 can be formed by a right-angle transition or an arcuate transition, as shown between the walls 82, 86. The arc of the left junction 114 can have a radius than the arc of a right junction 116 between the top wall 82 and the right side wall 84 in order to accommodate the dispensing drawer 106 or another component.

The dispensing drawer 106 and dispensing cartridge 104 can be vertically arranged relative to each other with the usable space 92. This permits the dispensing drawer 106 and the dispensing cartridge 104 to be accessed individually. As shown, the cartridge receiver 102 can be located below the dispensing drawer 106. While not shown herein, the dispensing drawer 106 and the cartridge receiver 102 can be integrally formed, such as by forming the cartridge receiver 102 within the dispensing drawer 106, such that both are accessed simultaneously.

One or more conduit(s) 118, 120 can be fluidly coupled between a household water supply and the dispensing drawer 106 and the dispensing cartridge 104, and can extend at least partially though the usable space 92. The conduit 118 can be fluidly coupled with the first cup 108 via an inlet port 156 formed in the housing 110 for dispensing a treating chemistry contained within the first cup 108, and fluidly coupled with a first chamber within the dispensing cartridge 104 for dispensing a treating chemistry contained within the first chamber from the dispensing cartridge 104. The conduit 120 can be fluidly coupled with the second cup 109 via a separate inlet port 158 formed in the housing 110 for dispensing a treating chemistry contained within the second cup 109, and fluidly coupled with a second chamber within the dispensing cartridge 104 for dispensing a treating chemistry contained within the second chamber from the dispensing cartridge 104. An outlet (not shown) from the dispensing drawer 106 can be formed in the treating chamber 20 and allows treating chemistry to be flushed from the cups 108, 109 into the treating chamber 20 with water supplied by the conduits 118, 120 extending into the drawer receiver 112. The conduits 118, 120 can extend through the usable space 92 in the area defined behind the housing 110. Rinse aid is dispensed from the rinse aid dispenser 107 through a similar outlet (not shown). A similar outlet can be provided for the dispensing cartridge 104. Valves (not shown) coupled with the controller 14 can be provided to selectively control the flow of water through the conduits 118, 120 to control the dispensing of treating chemistry from the dispensing drawer 106 and dispensing cartridge 104.

The water softening system 96 has a salt chamber opening 122 located with the usable space 92 and a salt chamber 124, which may be located outside the usable space 92, such as underneath the bottom wall 88 of the tub 18 as shown herein, or within the usable space 92 itself. The salt chamber opening 122 is provided in the left lateral flange 74 of the tub front 60, and a chute 126 can extend between the salt chamber opening 122 and the salt chamber 124, such that the salt chamber 124 may be filled with salt as needed via the opening 122. The chute 126 can be defined within a housing 128 that is separate from the housing 110 containing the chemistry dispensing system 94. In the illustrated embodiment, the salt chamber opening 122 is vertically arranged below the dispensing cartridge 104, although other locations are possible.

The air venting system 100 has a vent 130 located in the usable space 92. The vent 130 has a vent outlet 132 in the front of the tub 18, and is fluidly coupled to the treating chamber 20. For example, the vent outlet 132 can be fluidly coupled with a vent inlet 134 formed in the left side wall 84 of the treating chamber 20. While not shown herein, the door 22 can include an exhaust duct that fluidly couples with the vent 130 when the door 22 is closed. In the illustrated embodiment, the vent outlet 132 is vertically arranged between the dispensing drawer 106 and the dispensing cartridge 104, although other locations are possible.

The liquid reuse system 98 has a storage tank 136 located in the usable space 92 and in fluid communication with the recirculation system. The storage tank 136 can be provided behind the housings 110, 128 containing the components of the chemistry dispensing system 94, the water softening system 96, and the air venting system 110. The storage tank 136 can be an add-on component, or can be molded with the left side wall 86 of the tub 18. The storage tank 136 includes a conduit 138 in fluid communication with the sump 38 (FIG. 1) of the dishwasher 10.

The dishwasher 10 further has a second usable space 140 of the dishwasher 10 in which a control panel or user interface 142 of the electronic control system that is coupled to the controller 14 can be located. The second usable space 140 is formed above the open face of the treating chamber 20, such that the user interface 142 can be located in the front 60 of the tub 18 for storage. The second usable space 140 is defined between the top wall 82 of the treating chamber 20 and the top wall 64 of the tub 18. The usable space 140 is more specifically located between the tub outer periphery and the treating chamber periphery, and extends horizontally and laterally along the top wall 82 of the treating chamber 20. Other locations for the user interface 142 are possible, such as on the door 22, or within the first usable space 92.

The user interface 142 may include operational controls such as dials, lights, switches, and displays enabling a user to input commands, such as a cycle of operation, to the controller 14 (FIG. 1) and receive information. The user interface 142 may be selectively moved from a stored position behind or flush with the front 60 of the tub 18, shown in FIG. 3, to a use position at least partially in front of the front 60 of the tub 18, shown in FIG. 4. In the use position, a user may access the operational controls and displays of the user interface 142 to enter input into the dishwasher 10. The user interface 142 may be configured to slide between the stored and use positions and can have an electronically controlled sliding mechanism, like a CD player, or can have a mechanically controlled sliding mechanism, such as a push-push type mechanism.

Figure 5:
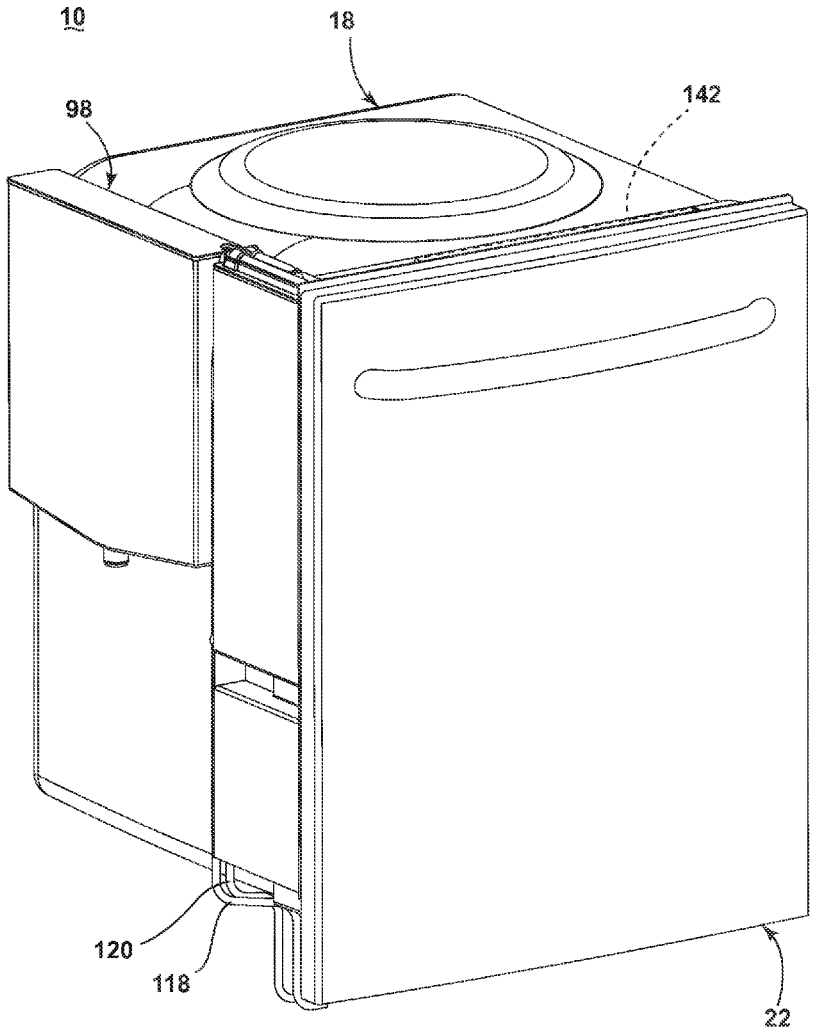
FIG. 5 is a left perspective view of the automatic dishwasher similar to FIG. 4, with the door in a closed position.

FIG. 5 is a left perspective view of the dishwasher 10, with the door 22 in a closed position. The door 22 may move between an opened position, shown in FIGS. 3-4, wherein the user may access the treating chamber 20, and a closed position, shown in FIG. 5, wherein the door 22 covers or closes the open face of the treating chamber 20. The door 22 comprises a door panel 144 having an inner face 146 that faces the treating chamber 20 when the door 22 is in the closed position. A seal 148 can be provided on the inner face 146 for fluidly sealing the treating chamber 22 relative to the door 22 when the door 22 closes the open face.

The door 22 can be sized to overlie the at least one usable space 92, 140 when the door 22 closes the open face. Further, the at least one subsystem or component in the usable space 92, 140 can be covered by the door 22 when the door 22 closes the open face. A door periphery 150 can be defined around the outer side of the seal 148, and can be in a confronting relationship with the front 60 of the tub 18 when the door 22 is in the closed position. As shown, the door periphery 150 can include a right lateral side 152 and a left lateral side 154. In the illustrated embodiment, the left lateral side 154 is wider than the right lateral side 152 in order to correspond to the dimension of the right and left lateral flanges 72, 74 of the front 60 of the tub 18. However, the overall outer dimensions of the door 22 can remain unchanged, and the door 22 can remain centered on the tub 18 even though the treating chamber 20 is not centered.

In the illustrated embodiment, with the dishwasher 10 installed in the cabinet 12 of FIG. 1, the door 22 will cover the chemistry dispensing system 94, the water softening system 96, the air venting system 100, and the user interface 142 when closed, as shown in FIG. 5. The liquid reuse system 98 will not be visible to user whether the door is open or closed, since it is positioned behind the chemistry dispensing system 94 and the air venting system 100.

Since many of the subsystems and components typically accommodated by the door 22 can be accommodated by the usable space, the door 22 can be unpowered, such that no powered components are provided within or on the door 22. If the door 22 is unpowered, wiring or other electrical connectors are not required to extend between the door 22 and the tub 18 or cabinet 12.

The method and apparatus disclosed herein provides a dishwasher with a usable space formed by offsetting the treating chamber 20 with respect to the tub 18. Conventional dishwashers have treating chambers which are centered within the tub 18. Since space is limited, components are typically located within the door, like a chemistry dispenser or a user interface, or behind the dishwasher, like a condensing system. One advantage that may be realized in the practice of some embodiments of the described systems and methods is that usable space is provided in the dishwasher 10 without negatively affecting the capacity of the treating chamber 20 or by expanding the dimensions of the dishwasher 10 outside a standard size.

Another advantage that may be realized in the practice of some embodiments of the described systems and methods is that components can be located in a more ergonomic location for a user of the dishwasher 10. In the embodiment used to illustrate the invention, the chemistry dispensing system 94 is provided along a side of the tub 18. Many prior dishwashers locate a dispensing system an interior surface to the door. When the door is opened to the horizontal position, such as is shown in FIGS. 3-4, the user must stoop down to load the dispensing system. The chemistry dispensing system 94 on the dishwasher 10 is advantageously positioned outside the door 22 in a location along a side of tub 18 that can be accessed without stooping. Furthermore, space for the chemistry dispensing system 94 can be provided by shifting the treating chamber 20 with respect to the tub 18, and not by affecting the overall size of the treating chamber 20. Also, the salt chamber opening 122 of the water softening system 96 is provided at the front 60 of the tub 18. Many prior dishwashers locate similar openings inside the treating chamber of the tub 18.

Another advantage that may be realized in the practice of some embodiments of the described systems and methods is that components such as the dispensing system 94 and user interface 114 are carried by the tub 18 of the dishwasher 10, rather than the door 22, which reduces the weight of the door 22 and allows the door 22 and its hinge assembly which couples the door 22 to the cabinet 12 to be manufactured less robustly at a lower cost.

Another advantage that may be realized in the practice of some embodiments of the described systems and methods is that the circuitry coupled with the controller 14 and user interface 142 can be routed around the cabinet 12 and tub 18 of the dishwasher 10, rather than the hinge assembly which couples the door 22 to the cabinet 12, which can further reduce the cost and complexity of the hinge assembly.

Another advantage that may be realized in the practice of some embodiments of the described systems and methods is that the added space along the side of the dishwasher 10 for the additive dispenser can also be co-opted for other components of the dishwasher 10, such as a bulk dispenser and a regeneration system, which tend to be less common components in current dishwashers.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher for treating dishes according to a cycle of operation, comprising:

a tub having a front defining an outer periphery;

a treating chamber defined by the tub and having an open face located at the front of the tub and within the outer periphery;

a cover selectively closing the open face;

a spraying system spraying liquid within the treating chamber;

a recirculation system recirculating the liquid within the treating chamber; and at least one subsystem with at least one component, wherein the at least one subsystem comprises at least one of: a chemistry dispensing system, a water softening system, a condensing system, a liquid reuse system, a regeneration system, an air venting system, or an electronic control system;

wherein the open face is laterally offset within the outer periphery and defines a usable space between the outer periphery and an exterior of the treating chamber and the cover is sized to overlie the usable space when the cover closes the open face;

wherein the at least one component is located within the useable space.

2. The dishwasher of claim 1 wherein the at least one component is accessible from the front of the tub.

3. The dishwasher of claim 2 wherein the at least one component is covered by the cover when the cover closes the open face.

4. The dishwasher of claim 1 wherein the at least one subsystem comprises the chemistry dispensing system and the at least one component comprises a treating chemistry reservoir.

5. The dishwasher of claim 4, wherein the treating chemistry reservoir comprises at least one of: a bulk dispensing cartridge removable through the front, a dispensing cup having an opening accessible through the front, or a dispensing drawer slidable through the front.

6. The dishwasher of claim 1 wherein the at least one subsystem comprises the water softening system having a salt chamber, and the at least one component comprises an opening provided in the front such that the salt chamber may be filled via the opening.

7. The dishwasher of claim 6 wherein the salt chamber is located within the usable space.

8. The dishwasher of claim 1 wherein the at least one subsystem comprises the condensing system and the at least one component comprises a condenser.

9. The dishwasher of claim 8 wherein the condenser comprises a heat exchanger.

10. The dishwasher of claim 1 wherein the at least one subsystem comprises the liquid reuse system and the at least one component comprises a tank in fluid communication with the recirculation system.

11. The dishwasher of claim 1 wherein the at least one subsystem comprises the air venting system and the at least one component comprises a vent having an opening in the front and fluidly coupled to the treating chamber.

12. The dishwasher of claim 11 wherein the cover comprises an exhaust duct that fluidly couples with the vent opening when the cover closes the open face.

13. The dishwasher of claim 1 wherein the at least one subsystem comprises the electronic control system and the at least one component comprises a user interface provided in the front of the tub.

14. The dishwasher of claim 1 wherein the cover further comprises a seal that fluidly seals the treating chamber relative to the cover when the cover closes the open face.

15. The dishwasher of claim 14 wherein the cover comprises a door movable relative to the open face.

16. The dishwasher of claim 15, wherein the door is unpowered.

17. The dishwasher of claim 1, further comprising an electronic control system having a user interface located in the front of the tub and above the open face of the treating chamber.

18. The dishwasher of claim 17 wherein the user interface may be selectively moved from a stored position, behind the front of the tub, to a use position in front of the front of the tub.

19. The dishwasher of claim 1 wherein the tub comprises a treating chamber peripheral wall defining a treating chamber periphery and the usable space is located between the tub outer periphery and the treating chamber periphery.

20. The dishwasher of claim 19 wherein the usable space extends vertically along a side of the treating chamber.

21. A dishwasher for treating dishes according to a cycle of operation, comprising:

a tub having a front defining an outer periphery;

a treating chamber defined by the tub and having at least one lateral side partially defining an open face located at the front of the tub and within the outer periphery;

a cover selectively closing the open face; and a dispensing system providing treating chemistry to the treating chamber and having at least one component;

wherein the treating chamber is not laterally centered within the outer periphery, which defines a usable space along the at least one lateral side and within the outer periphery, with the at least one component located within the usable space, and the cover is sized to overlying the usable space when the cover closes the open face.

22. The dishwasher of claim 21 wherein the at least one component comprises a treating chemistry reservoir.

23. The dishwasher of claim 22 wherein the treating chemistry reservoir comprises at least one of: a dispensing cartridge removable through the front, a dispensing cup having an opening accessible through the front, or a dispensing drawer slidable through the front.

24. The dishwasher of claim 23 wherein the tub further comprises a top wall coupled to a side wall to define a junction, and at least a portion of the treating chemistry reservoir is located at the junction.

25. The dishwasher of claim 24 wherein the junction is formed by an arcuate transition from the side wall to the top wall.

26. The dishwasher of claim 23 wherein the treating chemistry reservoir comprises both the dispensing drawer and the dispensing cartridge.

27. The dishwasher of claim 26 wherein the dispensing drawer and the dispensing cartridge are vertically arranged relative to each other with the usable space.

28. The dishwasher of claim 27, further comprising a vent system comprising a vent opening located in the space and the vent opening is provided in the front and is vertically arranged between the dispensing drawer and the dispensing cartridge.

29. The dishwasher of claim 28, further comprising a water softening system having a salt reservoir and a fill opening located in the front, and the fill opening is arranged below the dispensing cartridge.

30. The dishwasher of claim 29, further comprising an electronic control system having a user interface accessible through the front.

31. The dishwasher of claim 30 wherein the user interface may be selectively moved from a stored position, behind the front of the tub, to a use position in front of the front of the tub.

32. The dishwasher of claim 31 wherein the user interface is located in the front at a location above the open face.

33. The dishwasher of claim 27, further comprising a vent system comprising a vent opening located in the front.

34. The dishwasher of claim 27, further comprising a water softener having a salt reservoir with a fill opening located in the front.

* * * * *